United States Patent [19]

Winston

[11] 4,075,473

[45] Feb. 21, 1978

[54] CABLE-REINFORCED SAFETY BARRIER

[76] Inventor: George Winston, 1770 Bay Road, Miami Beach, Fla. 33139

[21] Appl. No.: 685,985

[22] Filed: May 12, 1976

[51] Int. Cl.[2] ..... E01F 15/00

[52] U.S. Cl. ..... 256/13.1; 404/6; 256/19

[58] Field of Search ..... 256/13.1, 1, 19; 248/66; 404/6

[56] References Cited

U.S. PATENT DOCUMENTS

| | | | |
|---|---|---|---|
| 2,337,626 | 12/1943 | Sawyer | 256/13.1 UX |
| 2,774,325 | 12/1956 | Budde | 256/13.1 UX |
| 2,907,552 | 10/1959 | Crone | 256/13.1 |
| 3,210,051 | 10/1965 | Case | 256/13.1 |
| 3,262,240 | 7/1966 | Schuman et al. | 256/13.1 UX |
| 3,404,526 | 10/1968 | Thomas | 256/13.1 X |

FOREIGN PATENT DOCUMENTS

| | | | |
|---|---|---|---|
| 1,220,751 | 1/1971 | United Kingdom | 256/13.1 |

*Primary Examiner*—Andrew V. Kundrat
*Attorney, Agent, or Firm*—Schuyler, Birch, Swindler, McKie & Beckett

[57] ABSTRACT

The safety barrier comprises a longitudinally extending rail rigidly engaged by support means disposed at intervals along the rail. A cable under tension is disposed proximate the rail and extends therealong so that the rail and cable combine to prevent failure of the barrier upon being impacted. In a preferred embodiment, the rail is cylindrical, the cable is disposed within the rail, and the cable is supported within the rail by a holding means such as grout. The barrier is constructed so that the grout may be inserted into the rail after the cable is in place and under tension. Moreover, in order to facilitate easy replacement of a damaged section, the rail may be removed from about the cable without replacing the cable and the cable is sheathed so that a damaged cable may be replaced without disassembly of the entire barrier.

16 Claims, 9 Drawing Figures

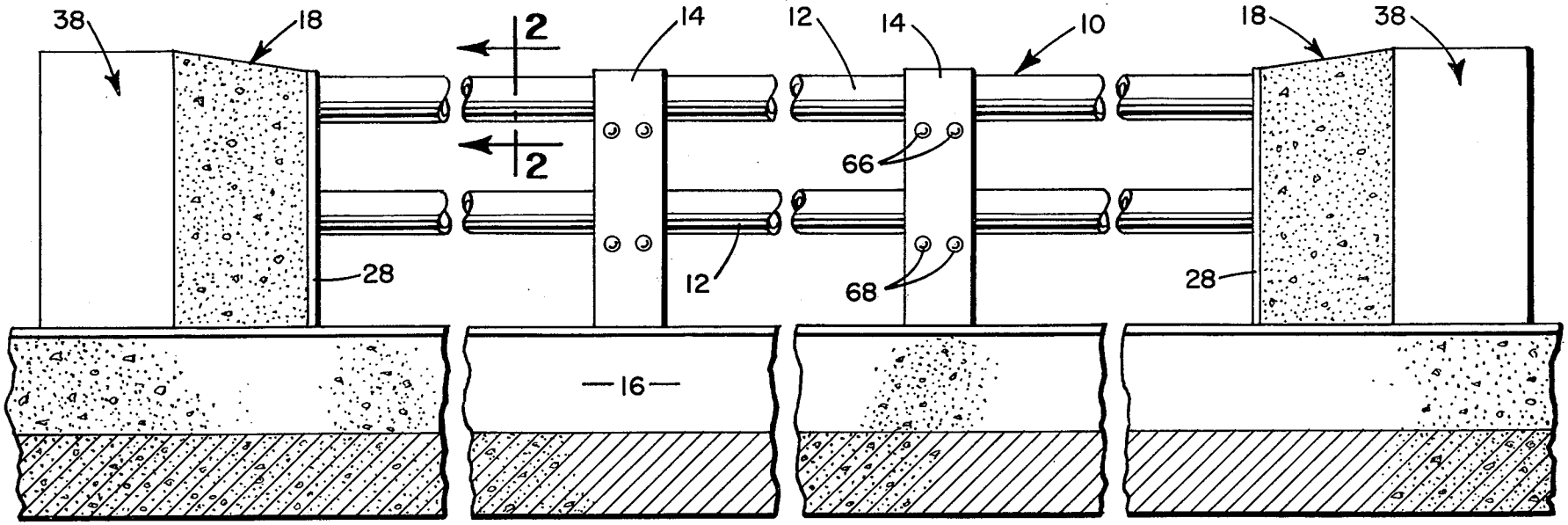
FIG. 1
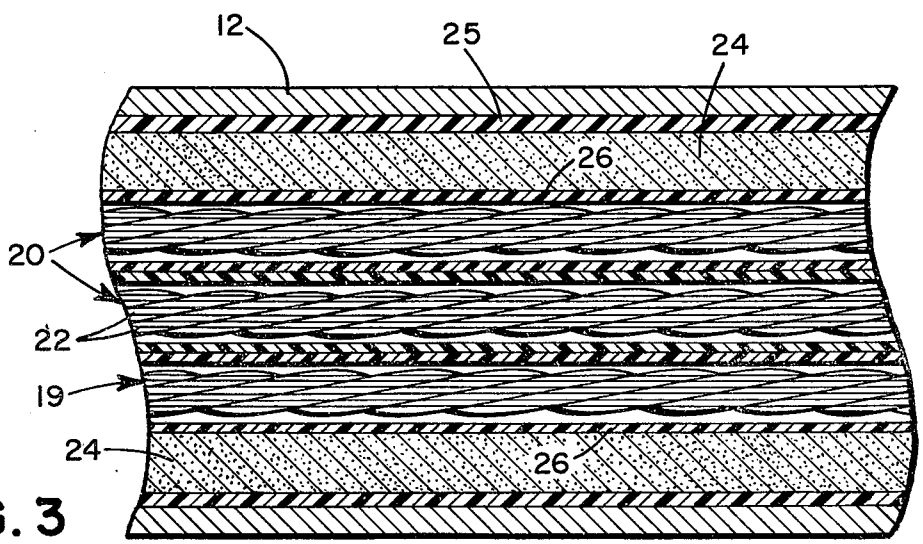
FIG. 3
FIG. 2
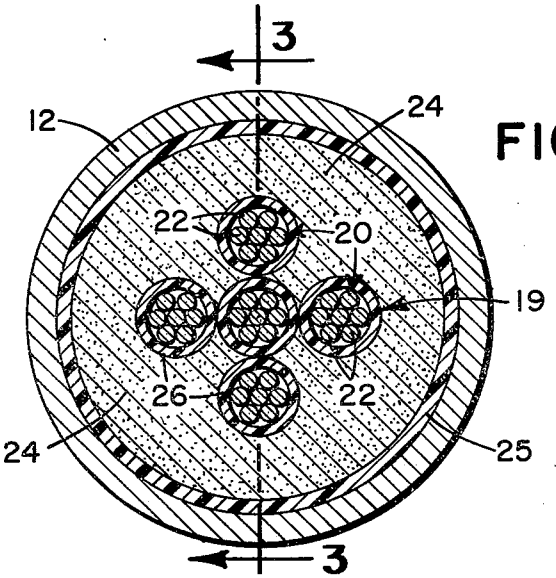

CABLE-REINFORCED SAFETY BARRIER

BACKGROUND OF THE INVENTION

1. Field of the Invention

The invention relates to safety barriers and, more particularly, to a cable-reinforced safety barrier adapted to be disposed adjacent a traffic area such as a highway and to improvements in existing safety barriers.

2. Description of the Prior Art

In the safety barrier art, conventional safety barriers are of several types. For example, it is well known to place a plurality of wooden posts along a roadway and affix one or more longitudinally extending cables to the post. The cables normally are not under tension, or if they are tensioned initially, they gradually sag after a period of time. This type of barrier is extremely ineffective and even dangerous because the posts are easily sheared. Additionally, when the cables are impacted, they generally extend to such a degree because of the lack of tension that there is little resistance to the movement of an impacting body. Furthermore, this type of barrier rarely extends to a height of more than about two feet with the result that a fast-moving vehicle often vaults the barrier with little resistance.

Another type of safety barrier comprises a longitudinally extending metal rail disposed adjacent a traffic area, which metal rail is supported by vertically extending metal posts at intervals therealong. The rail is much wider than the cable of the previously mentioned safety barrier, with the result that an impacting body is more likely to be deflected upon impacting the safety barrier. Because the barrier generally is comprised entirely of metal components, the barrier is less susceptible to catastrophic failure. Nevertheless, if a vehicle should impact the barrier at an angle approaching 90°, the rail oftentimes is not strong enough to stop the vehicle. Rather, the barrier either fails completely or a "pocket" in the rail is created with the further result that the vehicle directly impacts one of the posts.

Another type of safety barrier comprises a plurality of longitudinally extending cylindrical rails supported at intervals therealong by vertically extending parapets. This type of safety barrier functions in a manner quite similar to that of the second-mentioned type and commonly fails catastrophically or "pockets" to permit an impacting vehicle to directly engage one of the parapets. It is apparent that the conventional safety barrier has serious deficiencies as regards the ability to deflect or stop an impacting vehicle. As a result, many lives are lost needlessly.

Accordingly, it is an object of the invention to provide a new and improved safety barrier wherein catastrophic failure of the barrier is prevented or minimized greatly.

It is another object of the invention to provide a new and improved safety barrier wherein the deflecting characteristics of the barrier are increased and "pocketing" and vaulting of the rail are prevented or greatly reduced.

Another object of this invention is to improve existing safety barriers to prevent catastrophic failure and to minimize "pocketing" and vaulting of the barrier.

SUMMARY OF THE INVENTION

In carrying out the invention, in one form thereof, the safety barrier comprises a longitudinally extending rail rigidly engaged by support means disposed at intervals along the rail. A cable under tension is disposed proximate the rail and extends therealong so that the rail and cable combine to prevent failure of the barrier upon being impacted. In a preferred embodiment, the rail is cylindrical, the cable is disposed within the rail, and the cable is supported within the rail by a spacing means such as grout. The barrier is constructed so that the grout may be inserted into the rail after the cable is in place and under tension. Moreover, in order to facilitate easy replacement of a damaged section, the rail may be removed from about the cable without replacing the cable and the cable is sheathed so that a damaged cable may be replaced without disassembly of the entire barrier.

Many existing barrier systems employ cylindrical rails, in which case the cables are inserted into the existing rails, and cable anchoring means are provided to secure the ends of the cables external of the rails. Openings are made, as necessary, in the existing rails and associated structure, to permit the cables and the grout to be installed.

DESCRIPTION OF THE DRAWINGS

FIG. 1 is a side elevational view, partly in section, of one form of a safety barrier according to the invention.

FIG. 2 is a view taken along line 2—2 of FIG. 1 depicting an end view of one of the rails of the safety barrier of FIG. 1.

FIG. 3 is a view taken along line 3—3 of FIG. 2 depicting in cross-section one of the rails of the safety barrier of FIG. 1.

DESCRIPTION OF THE PREFERRED EMBODIMENT

Figure 4:
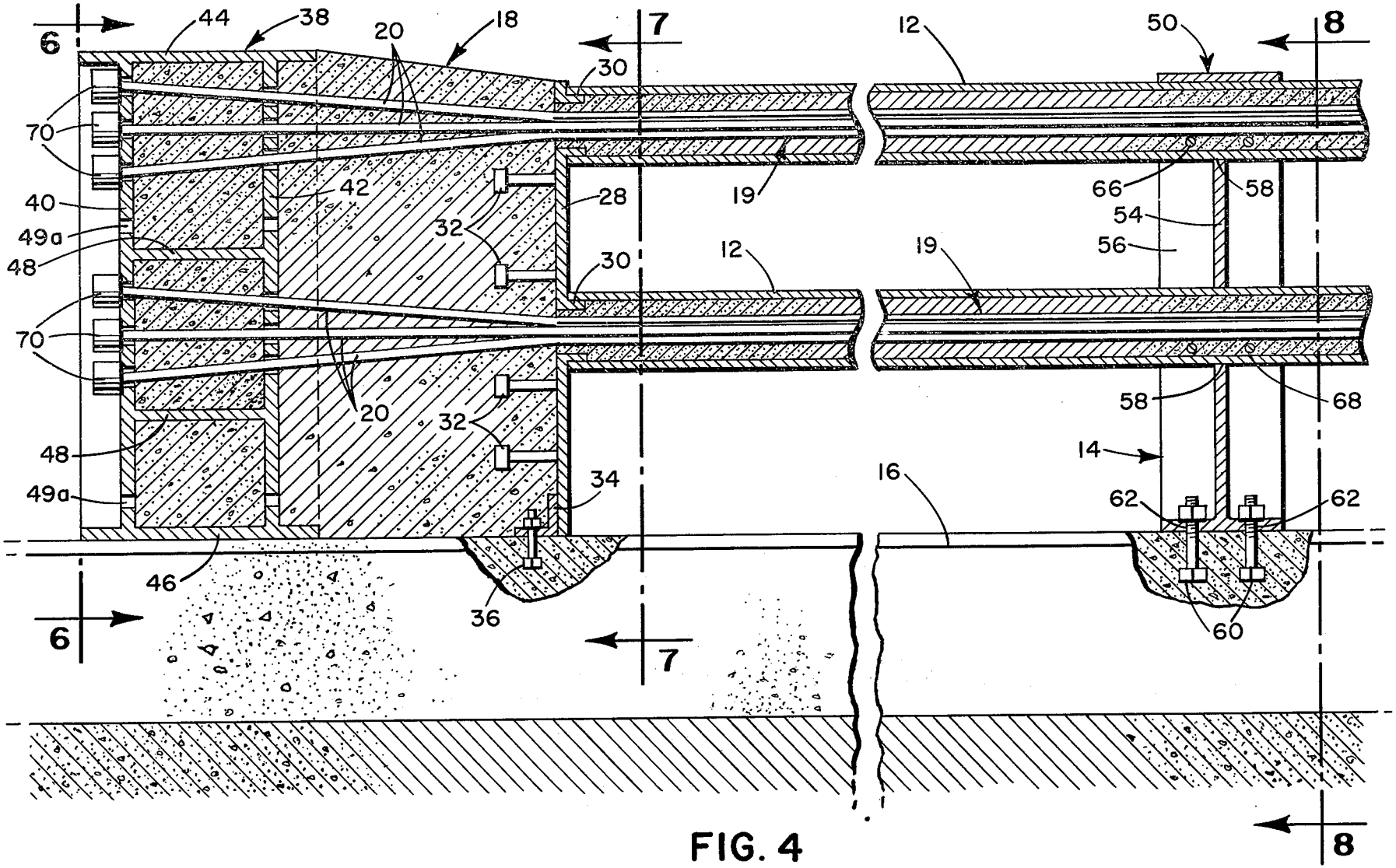
FIG. 4 is a side elevational view, in section, of the cable anchoring structure of the safety barrier of FIG. 1.

FIG. 1 shows a safety barrier 10 constructed according to the invention. In outward appearance, barrier 10 is quite similar to conventional safety barriers, or guardrails, commonly seen along highways and bridges. A particularly advantageous feature of the present invention is that it can be fitted into currently existing safety barriers. In such cash, the conventional safety barriers are significantly improved and strengthened without appreciable change in outward appearance.

Barrier 10 comprises a pair of longitudinally extening, cylindrical rails 12. Rails 12 may be comprised of any well known material, preferably steel or aluminum. Rails 12 are supported at intervals therealong by support means 14, which are commonly known as parapets, and which rigidly engage rails 12 to retain them against displacement upon impact. Support means 14 also are fixedly secured against movement thereof by a rigid engagement with concrete curb 16. Support means 14 either can be emplaced when curb 16 is formed, or can be attached to curb 16 by means of conventional bolted fasteners. Support means 14 can also extend through curb 16 into the ground beneath, or curb 16 can be dispensed with and the support means simply installed in the ground. Such installations are well known in the art.

An anchoring means 18 is disposed proximate each end of rails 12. Anchoring means 18 can function as the end support for rails 12, or it can be installed in addition to the end support for the rails, when an existing system is modified by this invention, for example. Anchor means 18 are comprised largely of concrete, although any conventional construction of the required strength can be used.

FIGS. 2 and 3 show detailed view of the interior of rail 12 and illustrate a preferred embodiment of the invention. A cable means 19 comprises a plurality of substantially identical cables 20 disposed within rail 12 and extending the full length thereof. Each cable 20 is of conventional design and comprises a plurality of twisted wires 22. It is to be understood that cable means 19 may be comprised of any other construction that has the required strength characteristics.

In order to support cable means 19 within rail 12 and prevent sagging thereof, a spacing means 24 is disposed within rail 12, surrounding cable means 19. By this construction, not only is cable means 19 prevented from sagging, but the strength of barrier 10 is increased greatly because of the mass added to rail 12.

Holding means 24 preferably is a grout such as concrete or epoxy. However, if desired, holding means 24 also simply could be comprised of a plurality of spaced brackets, periodically engaging and supporting cable means 19. Alternatively, holding means 24 could be dispensed with entirely, although the strength of barrier 10 would be decreased. If holding means 24 is comprised of concrete and rail 12 is comprised of aluminum, a liner 25 is disposed intermediate holding means 24 and rail 12, as shown in FIGS. 2 and 3, to prevent degradation of rail 12 through chemical reaction with the concrete. Liner 25 may be comprised of any well known material, such as paper, plastic, etc.

Each cable 20 can be sheathed in order to provide for the easy replacement. Sheath 26 preferably is comprised of any well known tubing material, such as polyethylene, paper, or aluminum. For purposes of the present invention, however, it is necessary only that sheath 26 permit each cable 20 to slide therein, so it can be removed and a replacement cable threaded therethrough.

FIG. 4 is a view similar to FIG. 3 and further shows a detailed, cross-sectional view anchoring means 18. Rails 12 engage a vertically extending face plate 28 having annular flanges 30 extending outwardly thereof. Rails 12 are adapted to engage and fit tightly about flanges 30 to firmly retain the end of rails 12. Face plate 28, in turn, is held in place by means of anchors 32 molded within anchoring means 18. The rigidity of end face 28 is further enhanced by means of angle iron 34 which engages end face 28 at the lower, inner surface thereof and which further is supported by bolted fasteners 36, engaging curb 16.

Anchoring means 18 also includes a cable end support 38, comprising a pair of vertically extending plates 40 and 42 having openings therein for each cable 20. The rigidity of support plates 40 and 42 is increased by top plate 44 and bottom plate 46. Moreover, support plates 40 and 42 are further strengthened by internally disposed brace plates 48. If desired, the cavities created by the aforementioned structure may be filled with grout through openings **49*a* in support plate 40 to further increase the strength of anchoring means 18. Pressure relief is provided by openings 49*b***.

Figure 7:
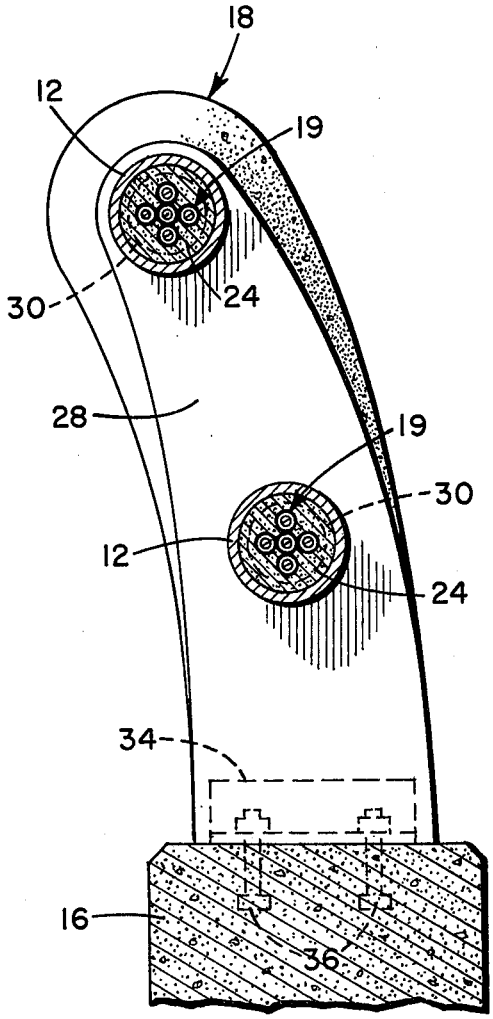
FIG. 7 is a view taken along line 7—7 of FIG. 4.
Figure 8:
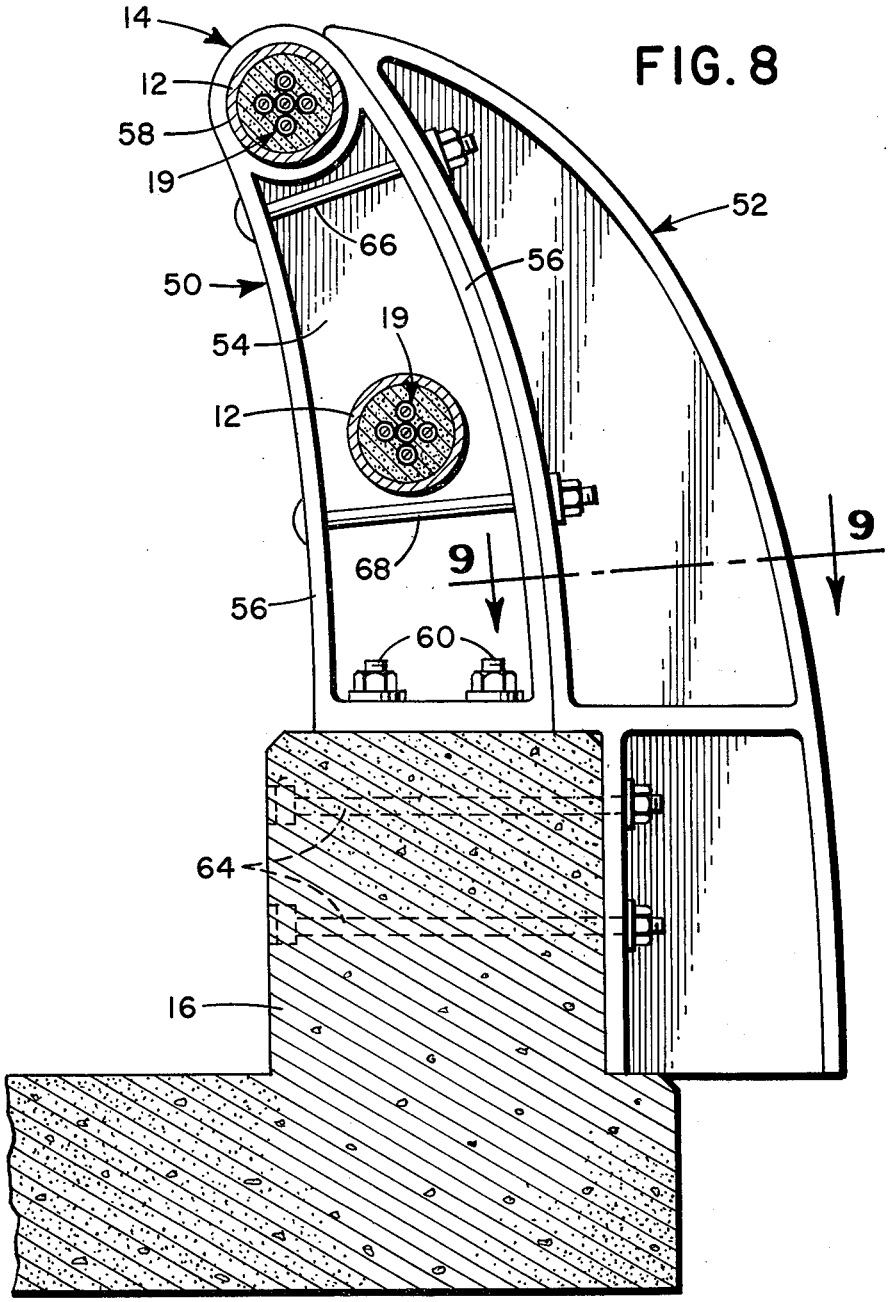
FIG. 8 is a view taken along line 8—8 of FIG. 4.
Figure 9:
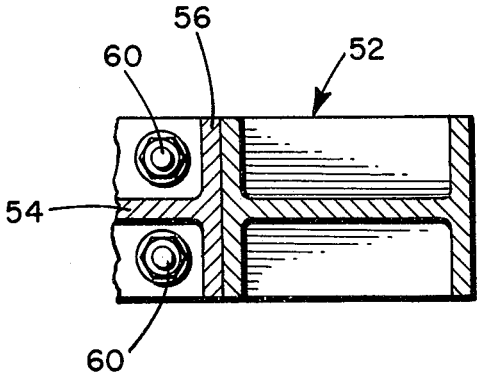
FIG. 9 is a view taken along line 9—9 of FIG. 8.

The details of support means 14 are shown best by FIGS. 4 and 6 through 9. Each support means 14 comprises a generally vertically extending parapet 50. If desired, a support 52 may be affixed to the back side of parapet 50 and the curb 16 to provide additional strength. Referring more particularly to FIGS. 4, 7 and 8, parapet 50 is comprised of a web portion 54 disposed rigidly within flange section 56. Web 54 is provided with a pair of openings 58 for the insertion and removal of rails 12. Openings 58 are designed appropriately to tightly engage rails 12 to prevent excessive flexing thereof. Support 52 is of similar construction to parapet 50, except that openings 58 are not provided. Parapet 50 is rigidly affixed to curb 16 by means of bolted fasteners 60 extending through openings 62 in the bottom of flange section 56 and molded into curb 16. Support 52 also is rigidly affixed to curb 16 in a similar manner by means of bolted fasteners 64. Support 52 also is rigidly affixed to parapet 50 by means of bolted fasteners 66 and 68. The heads of bolted fasteners 66 and 68 are rounded to minimize damage to an impacting body and to increase the chances that an impacting body will be deflected.

Figure 5:
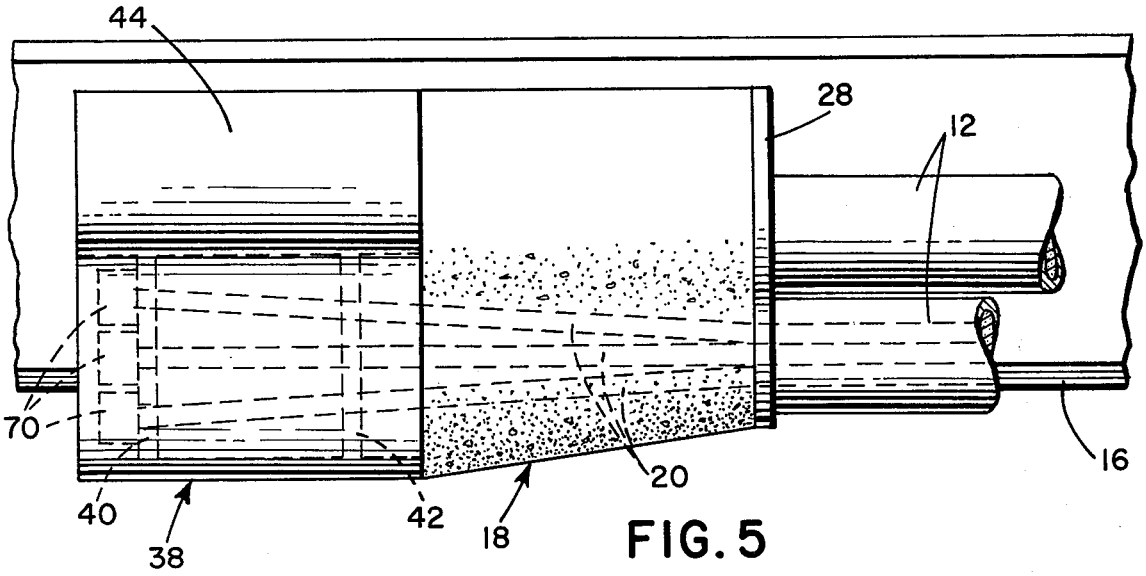
FIG. 5 is a plan view of the end of the cable anchoring structure shown in FIG. 4.
Figure 6:
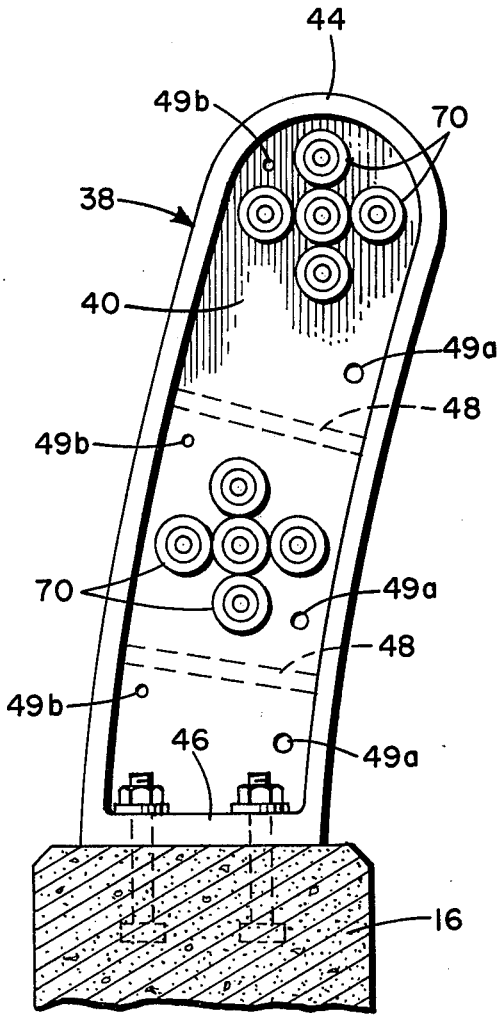
FIG. 6 is a view taken along line 6—6 of FIG. 4.

In order to improve the operating characteristics of barrier 10, cable means 19 is tensioned. This is provided by cable gripping members 70, as shown best by FIGS. 4, 5 and 6. Cable gripping members 70 are of conventional design and, after each cable 20 has been tensioned, firmly engage each cable 20. Cable means 19 is prevented from relaxing because cable gripping members 70 abutt support plate 40.

In operation, assuming a new construction, parapets 50, supports 52, rails 12, end plates 28, and cable end supports 38 are set in place. Thereafter, cable means 19 is inserted through rail 12 and the openings in support plates 40 and 42. Cable means 19 is then tensioned. After tensioning, holding means 24 are inserted and allowed to harden. It is pointed out that cable means 19 is spaced from the inner walls of rail 12. This is occasioned by annular flange 30 which prevents cable means 19 from expanding excessively sideways under tension. If desired, a ring of appropriate thickness (not shown) may be fitted within flange 30 to further limit the sideways expansion of cable means 19. After hardening, spacing means 24 prevents cable means 19 from sagging, even if the tension in cable means 19 should decrease. Alternatively, cable sheaths 26 can first be installed, along with spacing means 24, and then cable means 19 is inserted and placed under tension. Or, spacing means 24 can be installed prior to the tensioning of the installed cables, but the cables should be tensioned before holding means 24 is allowed to harden, for otherwise cable means sag, and the later tensioning would undesirably load the spacing material.

By the construction of the present invention, it will be apparent that cable means 19 may be replaced readily in the event of being damaged. It is anticipated that this will be facilitated by color coding each cable 20. It is possible that only a section of rails 12 would be damaged in the event of being impacted. Replacement of only a section of rails 12, nevertheless, is an easy matter. First, the damaged portion of rail 12 is removed from about cable means 19. If spacing means 24 is comprised of grout, the grout most likely would be cracked. In this event, it also would have to be removed from about cable means 19. Furthermore, if any of the cables are damaged, they must be replaced by threading a new cable through sheath 26. Thereafter, a new section of rail 12 is placed about cable means 19. Preferably, this would be facilitated by fabricating rails 12 in half-sections which may be fitted together about cable means 19. After the new section of rail 12 is in place, fresh grout is pumped through an opening in rail 12 (not shown) and allowed to harden. When completed, the assembly would retain substantially the outward appearance of the original barrier.

The advantages of the present invention are apparent. For example, by appropriately selecting the size and number of cables 20 and by selecting a holding means 24 of appropriate density and strenght, the stopping capacity of safety barrier 10 is improved significantly over any prior art safety barriers. The cables, in conjunction with rails 12, will be able to absorb an extremely large amount of energy without catastrophic failure. By this construction, vaulting of the safety barrier is substantially eliminated and "pocketing" as occurs in conventional safety barriers likewise is substantially eliminated. It will be appreciated that the present invention has a unique capacity gradually to absorb energy, a significant difference over prior art designs which do not have this capability. Another significant advantage of the present invention is its relatively low cost, whether by way of new construction or refabrication. Because of its inexpensiveness, the present invention may be applied readily to any existing safety barrier or new construction.

It is also pointed out that rails 12 need not be cylindircal, nor is it required that cable means 20 be disposed within a hollow portion of rails 12. For example, certain conventional safety barriers are comprised of a longitudinally extending rail having a "W" shape when viewed from the end. With this type of barrier, it will be sufficient for cable means 19 to be disposed within the recessed portion of the rail and retained therein by some type of attachment.

The unique advantages of the present invention arise from the combined use of a rail in whatever form and tensioned cable means of appropriate strength. Accordingly, while a specific embodiment of the invention has been described, it will be obvious to those skilled in the art than many changes and modifications may be made without departing from the invention. It is therefore intended in the scope of the invention is governed only by the appended claims.

I claim:

1. A safety barrier comprising:

substantially horizontal rail means having a recess, support means supporting said rail means at intervals along the length thereof, cable means disposed in said recess, cable holding means disposed within said recess and comprising a mass of grout or the like interposed between the outer surface of said cable means and the inner surface of said rail means, and extending along at least portions of said rail means, and cable anchoring means at each end of said cable means, said cable means being secured to said anchoring means.

2. The safety barrier of claim 1 wherein said cable means is held under tension by said anchoring means.

3. The safety barrier of claim 1 wherein said rail means comprises a hollow tube, defining said recess and said cable means is disposed inside said tube.

4. The safety barrier of claim 3 wherein said holding means holds said cable means spaced from the inner surface of said tube.

5. The safety barrier of claim 4 wherein said mass of grout fills substantially all of the free space within said tube.

6. The safety barrier of claim 5 further comprises a sheath surrounding said cable means so that said cable means does not contact said mass of grout.

7. The safety barrier of claim 5 wherein said cable means is held under tension by said anchoring means.

8. The safety barrier of claim 7 further comprising a second said hollow tube having a second said tensioned cable means surrounded by a grout within said hollow tube.

9. The safety barrier of claim 8 wherein said support means comprises a plurality of spaced generally vertically oriented support posts anchored to the ground.

10. The safety barrier of claim 9 wherein each of said support posts comprises a first post member attached to said hollow tubes and a second post member engaging said first post member.

11. The safety barrier of claim 9 wherein each end of each said rail means terminates at one of said anchoring means.

12. The safety barrier of claim 11 wherein said cable means comprises a plurality of individual cables.

13. The safety barrier of claim 1 wherein said support means comprises a plurality of generally vertically oriented posts spaced along the length of said rail means, each said post comprising a first post member attached to the top of a curb and a second post member engaging said first post member and attached to the side of said curb.

14. In a safety barrier having a substantially horizontally oriented hollow tubular rail means supported at intervals by a plurality of spaced substantially vertically oriented post means, the improvement comprising cable means disposed within said hollow tubular rail means, anchoring means at each end of said rail attached to the said cable means for anchoring said cable means, and a mass of grout or the like is interposed between said cable means and said tubular rail means at least along portions of the length thereof to support said cable means spaced from said tubular rail means.

15. The safety barrier of claim 14 wherein said improvement further comprises holding said cable means under tension by means of said anchoring means.

16. The safety barrier of claim 14 wherein said improvement further comprises a sheath surrounding said cable means to preclude contact with said grout.

* * * * *